US008234764B1

(12) United States Patent
Wracker

(10) Patent No.: US 8,234,764 B1
(45) Date of Patent: Aug. 7, 2012

(54) MULTI-PURPOSE PRYING TOOL

(76) Inventor: Daniel Wracker, Prospect, PA (US)

( * ) Notice: Subject to any disclaimer, the term of this patent is extended or adjusted under 35 U.S.C. 154(b) by 0 days.

(21) Appl. No.: 13/200,082

(22) Filed: Sep. 16, 2011

Related U.S. Application Data

(60) Provisional application No. 61/464,221, filed on Mar. 1, 2011.

(51) Int. Cl.
*B25B 9/00* (2006.01)

(52) U.S. Cl. ..... 29/268; 29/270; 29/278; 29/275; 81/416; 81/423

(58) Field of Classification Search ..... 29/268, 29/257, 276, 278, 280, 275
See application file for complete search history.

(56) References Cited

U.S. PATENT DOCUMENTS 5,862,552 A * 1/1999 Koelewyn ..... 7/132
5,893,201 A * 4/1999 Myers ..... 29/268
6,386,076 B1 * 5/2002 Swanstrom, Jr. ..... 81/423
7,197,967 B2 * 4/2007 Crawford ..... 81/426.5
7,249,752 B1 * 7/2007 Foley ..... 254/23
7,578,218 B2 * 8/2009 Hood et al. ..... 81/3.44
7,703,748 B2 * 4/2010 Foley ..... 254/23
7,950,122 B2 * 5/2011 Saylor ..... 29/268

* cited by examiner

*Primary Examiner* — Lee D Wilson
(74) *Attorney, Agent, or Firm* — Gary P. Topolosky

(57) ABSTRACT

A multi-purpose tool that makes prying possible without need of a lever point. The tool comprises a pair of handles pivotally connected at an intermediate pivot joint, each handle comprising a gripping section, an intermediate section and a front tip section all located on a same side of the pivot joint such that movement of the gripping sections towards each other spreads the front tip sections apart. The pivot joint, situated between intermediate handle sections, includes a substantially circular pivot pin on a substantially planar base and a protective cover for situating over the pivot pin and further rotationally joining both handles.

20 Claims, 10 Drawing Sheets

MULTI-PURPOSE PRYING TOOL

CROSS-REFERENCE TO RELATED APPLICATION

This application claims priority to U.S. Provisional Application Ser. No. 61/464,221, filed on Mar. 1, 2011 and entitled "Prymates, a Universal Power Pryer", the disclosure of which is fully incorporated by reference herein.

BACKGROUND OF THE INVENTION

1) Field of the Invention

This invention relates to pliers having a pair of squeezable handles. The invention further relates to a tool that can serve as a universal prying device. It provides multiple plying forces superior to those associated with crowbars and pry bars especially since it does not require wedging against another surface to function. It can act as a true "stand alone" prying mechanism. In a first preferred embodiment, the forward most tips of this plier-pryer set are supplied with elongate needle nose edges . . . most preferably, one tip being longer and overlapping the other. In a first alternative embodiment, one of the two plier-pryer tips is provided with a toothed claw for nail and stud removal. In another embodiment, the multi-purpose tool is provided with quickly connecting/disconnecting tips for interchangeable prying uses. In yet another variation, the pryer-pliers are fitted with a central edge surface for cutting, and possibly also stripping, wire.

Most preferably, the tool of this invention is supplied with integral handle arms or supports, from a hardened steel alloy substantially surrounded on both sides with more amenable, easier to handle gripping material (i.e. rubber, plastic, etc.). With this preferred embodiment, the tool may be hammered from one or both handles after being situated into an area needing to be pried apart.

End uses for this tool include prying apart carpentry molding without damaging same, disassembling various motorcycle and other small engine components, including engine heads and side covers held together by worn out gaskets (without having to leverage against adjacent parts or surfaces), worn hoses from their radiator or other engine connections, separating components that are virtually stuck to one another (as if glued together) through gunk build up and/or worn spacers over time, removing circuit chips from their motherboards, separating freely standing wood piles nailed to each other but to no other firmly fixed surface and/or prying open the links of a free-standing chain. It is especially useful in those circumstances where crowbar/pry bars might otherwise work but at the risk of damaging adjacent surfaces or where such prior art devices (crowbars and/or prybars) just won't fit. Still larger versions may be suitably used for building demolition and/or for fire and other emergency vehicle first responder rescues.

2) Description of Relevant Art

In chronological order, there is known a piston ring remover, as disclosed in Landaw U.S. Pat. No. 1,324,557. It includes a pair of handles which when squeezed together will cause the upper jaws to spread apart a piston ring for easier removal.

In Epstein U.S. Pat. No. 3,762,019, that tool is made convertible by having a central pivot screw adjust between left and right aperture settings. When its handles are squeezed together, the top tip pairs to the Epstein tool spread apart for assisting with the manual removal of spring retaining clips or rings.

The convertible plier tool of Medved U.S. Pat. No. 5,865,075 included means for spreading apart jaws when its lever handles were moved together, then converting to the opposite so that its jaws can be brought together rather than apart.

Reversible jaw tips is the focus of Lin U.S. Pat. No. 6,257,105 for the snap ring pliers shown and described therein.

But none of the preceding tools show a plier/pryer spreading assist having handles which may be hammered in place before manipulation to spread apart the levered arms. Nor does any of the art show offset pryer tips that can be wedged behind molding and other woodwork applications. Alternately, one embodiment of this invention includes a nail pulling claw tip. Yet another variation incorporates wire cutters and/or wire stripping apertures along the lever handles nearest the connecting means to this tool for even greater end use applicability.

SUMMARY OF THE INVENTION

A primary objective of this invention is to provide prying-type pliers comprised of two similar in length, similarly-shaped handles contiguous to an overlaid mounting pin/connecting section that allows for lateral movement of the two handles thereabout. At the far ends to both handles, there is situated a pair of aligned jaws or prying tips. In one embodiment, the prying tips are purposefully asymmetrical so that a forward-most edge to one tip can be used for wedging behind materials that need to be pried apart or away from a wall. The asymmetrical design enables the prying pliers to be hammered down, if need be, when the prying handles are spread apart or even when fully or partially squeezed together. The forward-most tip is sufficiently sturdy to withstand hammering into place either when closed over its partnering, adjoining pryer tip, or when left fully or partially "open". An alternate embodiment employs asymmetrical prying tips with one of said tips having a clawed (or split tooth) end so as to be suitable for staple and/or nail extractions. Yet another variation, preferably interchangeable with the first two tip pairs, employs fully symmetrical tip ends/edges. On a more preferred basis, the inner adjoining edges to the two handles are provided with matching, beveled edges that can be used for cutting wire. If one or more circular apertures are situated in those same bevels or immediately adjacent, the same tool can be used to strip the outer coating to electrical wiring.

Another objective of this invention provides pryer-pliers in which innovatively structured tips can be substituted for one another. Removal of a first tip pair and replacement with an alternate use tip pair may be readily and yet rapidly accomplished to fabricate multiple prying applications/orientations.

The foregoing are accomplished with a multi-purpose tool that makes prying possible without need of a lever point. The tool is comprised of a pair of handles pivotally connected at an intermediate pivot joint, each of the two handles comprising a gripping section, an intermediate section and a front tip section all located on a same side of the pivot joint such that movement of the gripping sections towards each other spreads the front tip sections apart. The pivot joint, situated between intermediate handle sections, includes a substantially circular pivot pin on a substantially planar base and a protective cover for situating over the pivot pin and further rotationally joining both handles.

BRIEF DESCRIPTION OF DRAWINGS

Further features, objectives and advantages of the present invention will become clearer when referring to the following detailed description of preferred embodiments made with reference to the accompanying drawings in which.

DESCRIPTION OF PREFERRED EMBODIMENTS

Figure 1A:
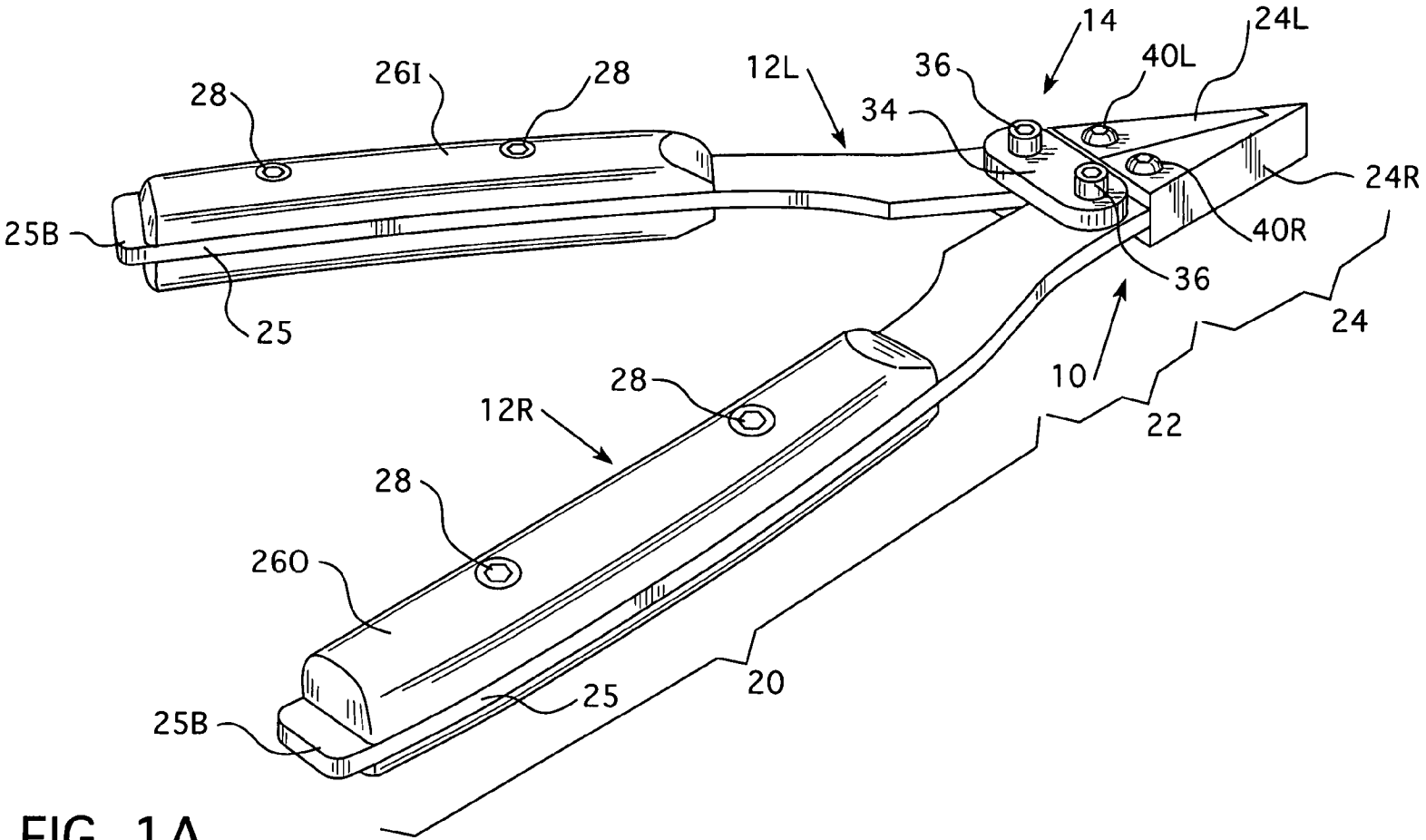
FIG. 1A is a perspective view of the first embodiment of tool with asymmetric tips from its lower right corner handle before being squeezed to pry something apart.
Figure 1B:
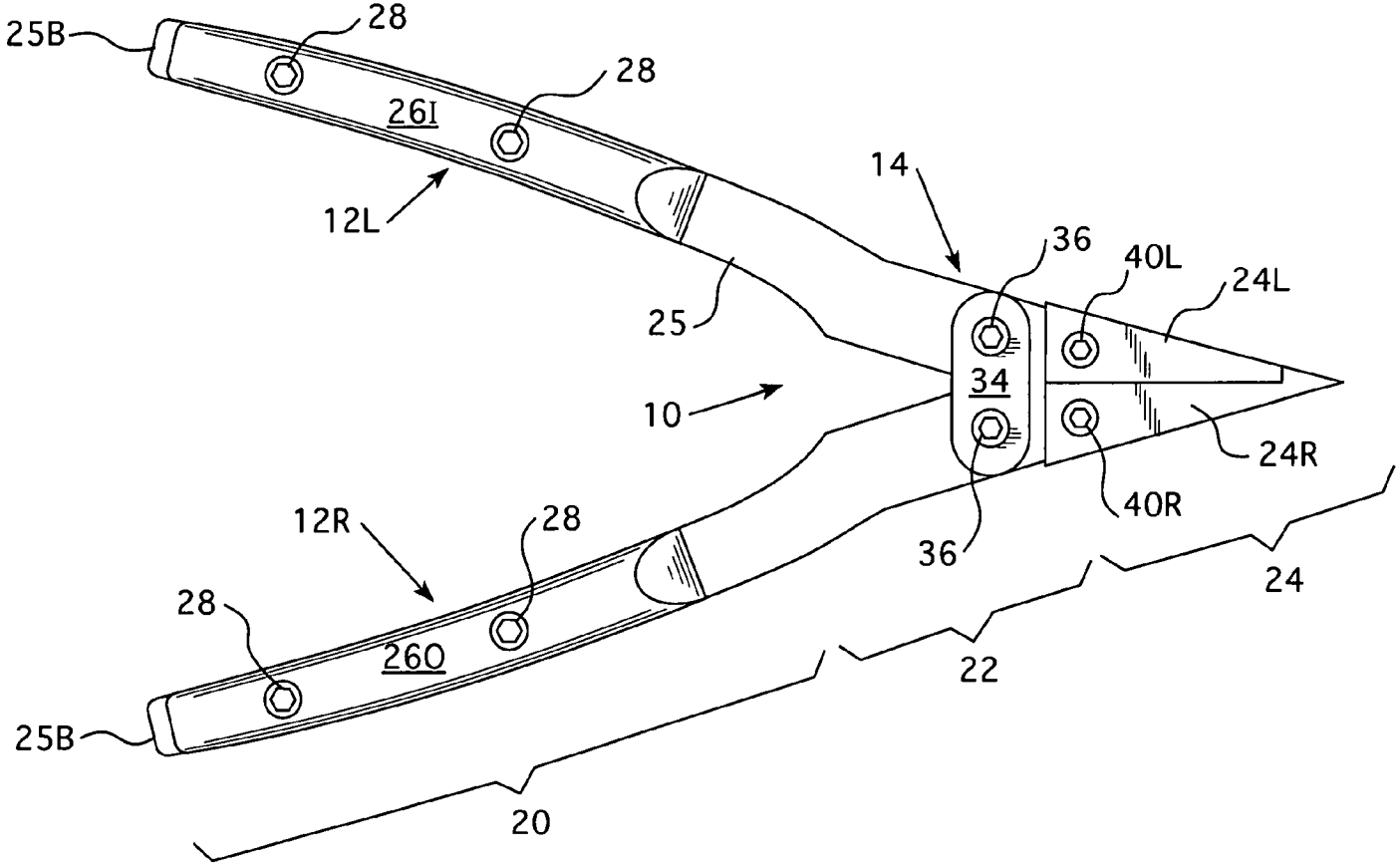
FIG. 1B is a top plan view of that first embodiment with its pry tips closed.
Figure 1C:
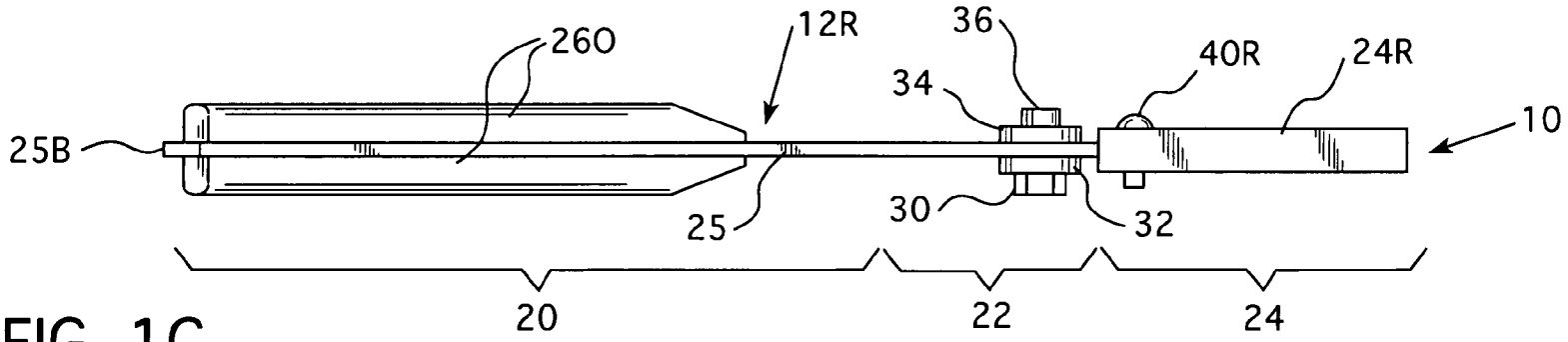
FIG. 1C is a plan view of the right side of the tool from FIGS. 1A and B.
Figure 1D:
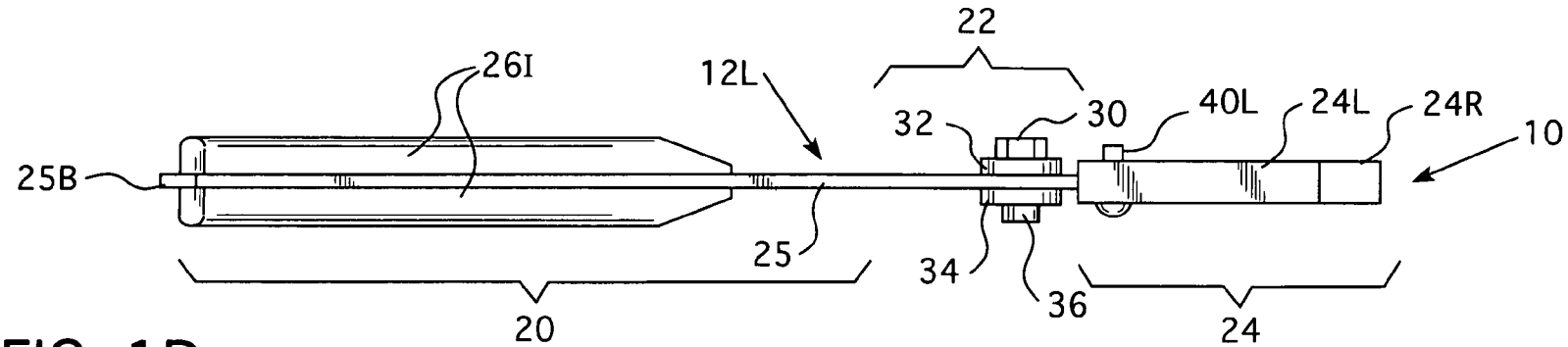
FIG. 1D is a plan view of the left side of the tool from FIGS. 1A and B.
Figure 2A:
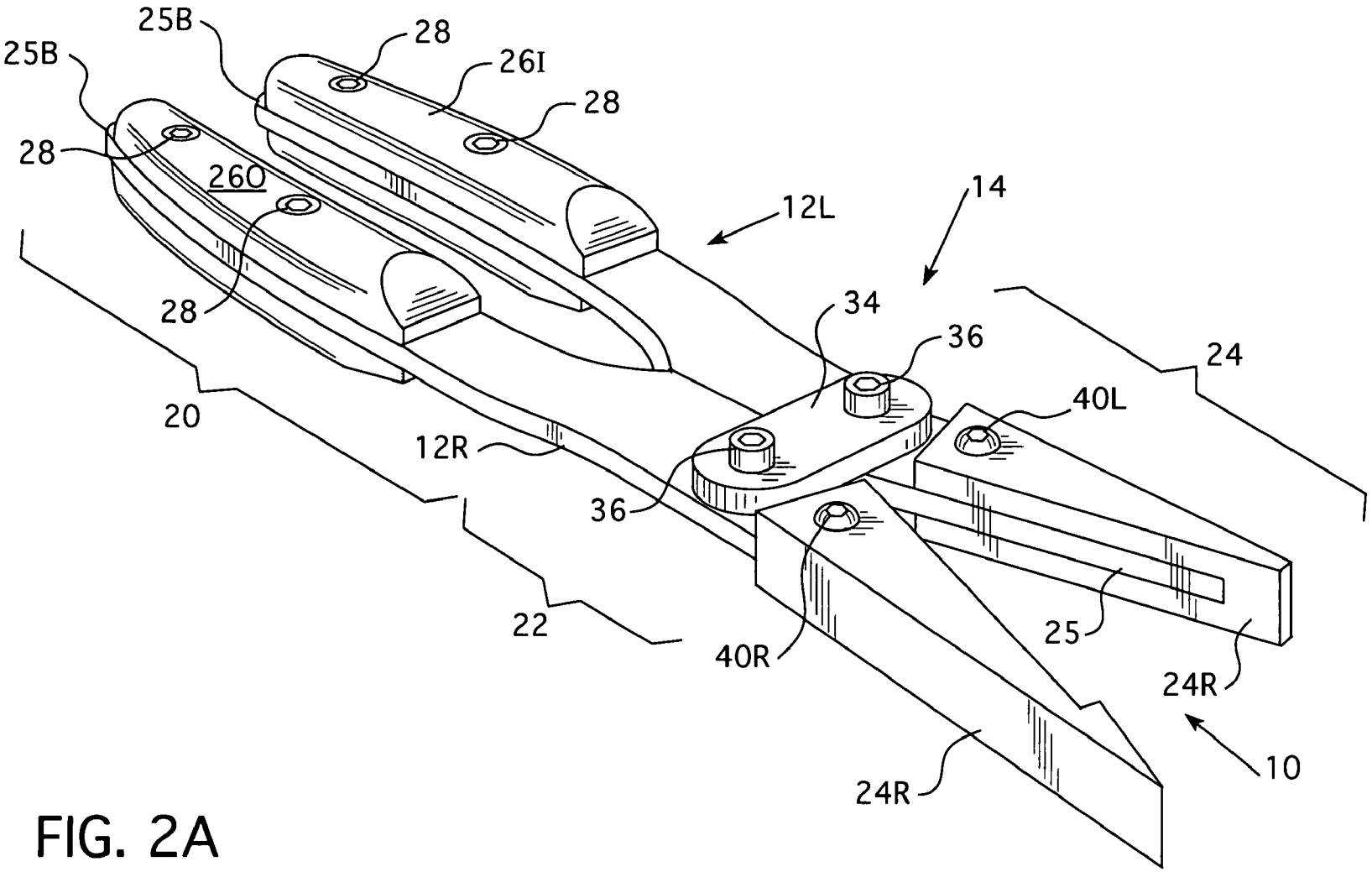
FIG. 2A is a perspective view of the FIG. 1A tool from its upper right corner with the handles squeezed together.
Figure 2B:
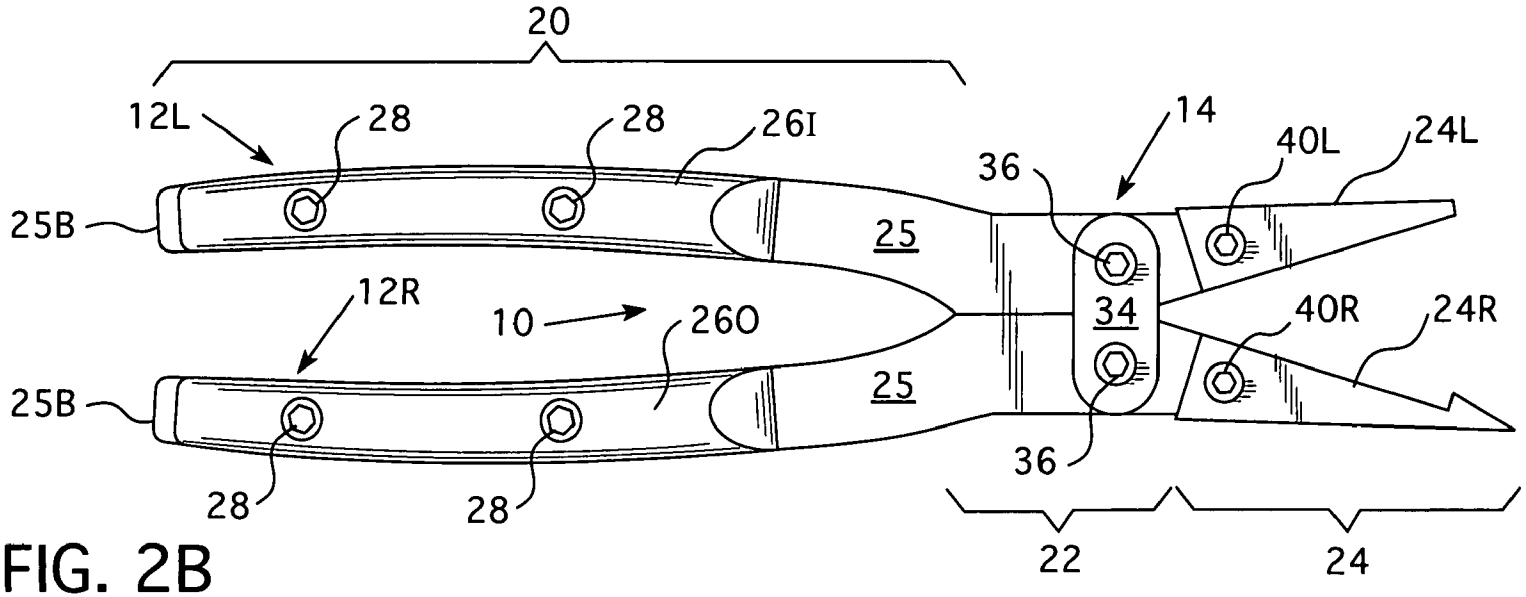
FIG. 2B is a top plan view of the tool from FIG. 2A.
Figure 2C:
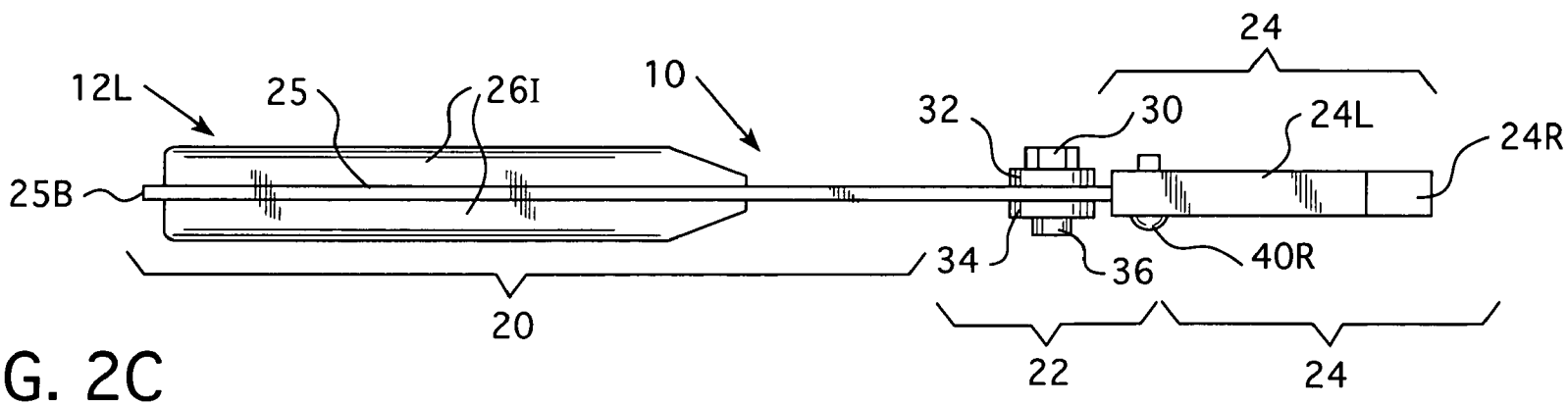
FIG. 2C is a plan view of the left side of the tool from FIG. 2A.
Figure 3A:
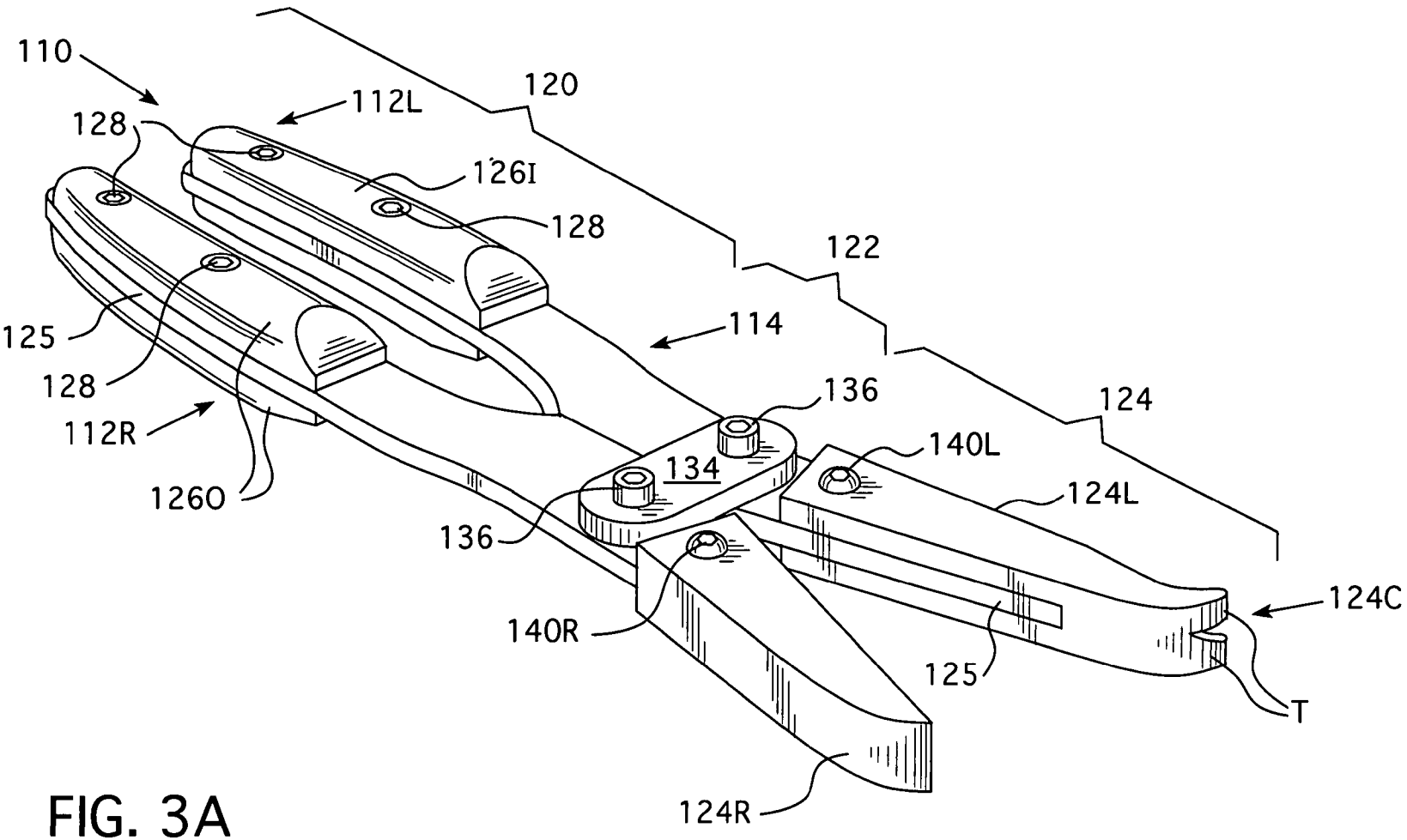
FIG. 3A is a perspective view of a second tool embodiment having one claw tip from its upper right corner before being squeezed to pry something apart.
Figure 3B:
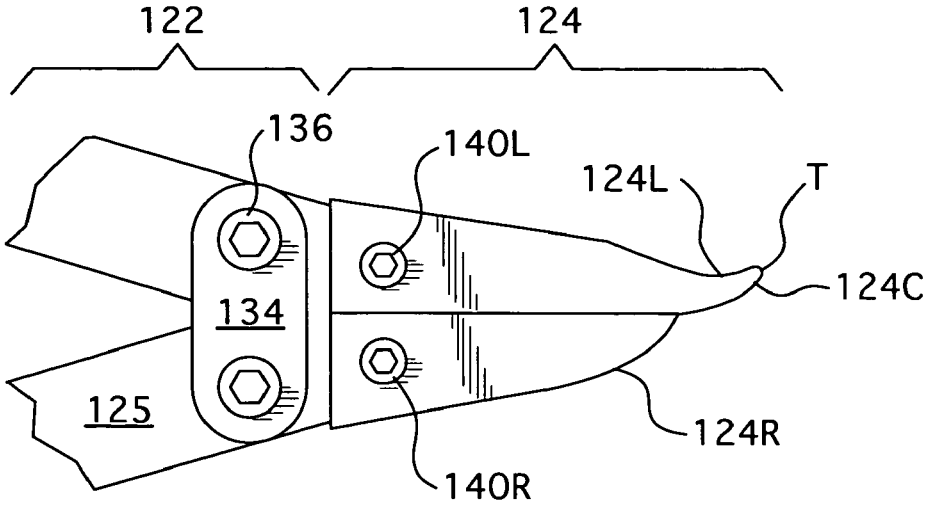
FIG. 3B is a top plan view focusing on the tips to the tool from FIG. 3A.
Figure 3C:
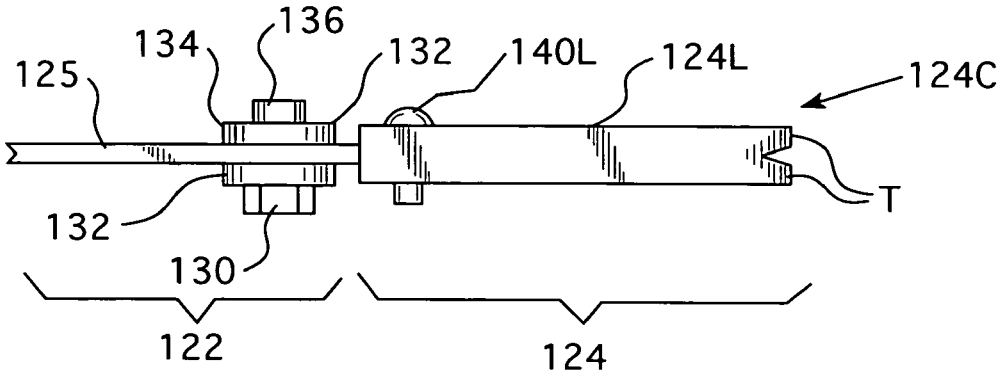
FIG. 3C is a plan view of the left side of the tool tips from FIG. 3B.
Figure 3D:
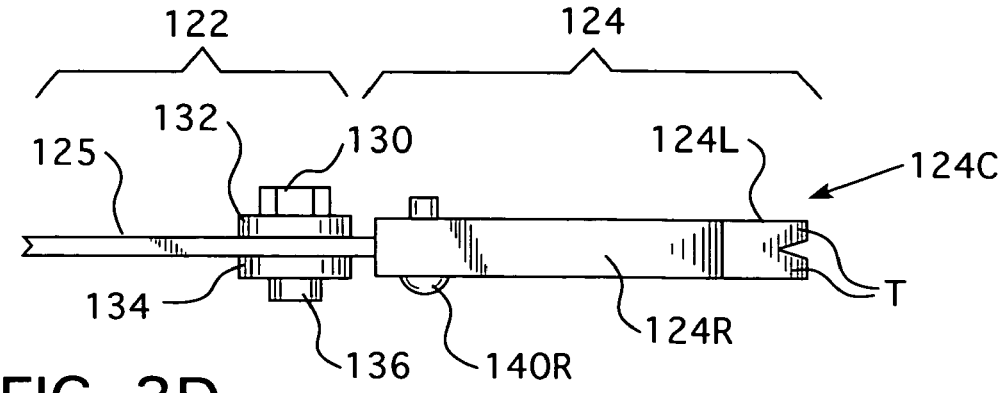
FIG. 3D is a plan view of the right side of the tool tips from FIG. 3B.

Common features in the different views of this invention are shown with the same reference numeral(s). For alternate embodiments of the same component, there is consistent numbering though in the next hundred series. When referring to any numerical range herein, it should be noted that all numbers within the range, including every fraction or decimal between its stated minimum and maximum, are considered to be fully designated and disclosed hereby. As such, disclosing an overall preferred tool length ranging from about 4 to 20 inches would expressly cover all other lengths from 4.2, 4.4 and 5 or 6 inches (for the smaller scale version of this tool, up to and including about 18.5, 19 and 19.75 inch long varieties. Similarly, a total tool tip length ranging from about 0.5 to 2 or 3 inches maximum, and a total handle length ranging from about 3 to 15 or 16 inches, includes all measured points in between. And a total tool width before the handles are squeezed (or otherwise brought) together may range from about 2 to 5 or 6 inches (and/or all points in between). In essence, there can be a small, intermediate and large model of pryer-pliers for multiple end-use applications.

Referring now to FIGS. 1A through 2C, there is shown a first preferred embodiment of tool device according to this invention for enabling the application of multiplied spreading (or expansion/expansive) forces between adjacent objects and/or surfaces. This tool, generally 10, consists of a pair of lever handles 12L and 12R pivotally connected at an intermediate pivot joint, generally 14. Though these lever handles 12 are labeled L and R, this is for ease of description; the left L and right R handles may be easily reversed for use by an opposite-handed (left or right-handed) operator and are more often universal for either left or right-handed type operation.

Each lever handle 12L or R comprises a gripping section 20, intermediate section 22 and front tip section 24 all along the same (left OR right) side of pivot joint 14 such that operator movement (indicated by arrows A) of gripping sections 20L and R towards each other spreads front tip sections 24L and R apart, or directionally away from one another. Both gripping sections 20L and R include a central metal plate 25 about which inner or upper hand grip 26I and outer or lower hand grip 26O are secured. In these views, the hand grips are held in place with a plurality of multi-layered rivets 28, though it is to be understood that numerous other handle grip connection means may be used to supplement and/or substitute for same. Note that at least some lowermost section/portion of metal plate 25 extends downwardly below the hand grips 26I and O sandwiching same on either side. That section preferably terminates in a substantially planar base 25B on both arms as shown (though, in alternate embodiments, this base need only be included on just one arm/lever handle). This base 25B enables the tool of this invention to be better hammered into place, as a wedge, if need be, before any additional operations (i.e. handle squeezing and forward/front tip moving) commences.

In one embodiment, metal plate 25 is made from hardened steel alloy. To a lesser degree, other hard metal alloys may be substituted therefor. The hand grips 26I and O surrounding metal plate 25 may be made from plastic, rubber and/or composite materials for the most comfortable operator use of said device. One such material is the polymer-based gripper handle made from a StarBoard marine polymer.

Pivot joint 14 consists of a substantially circular pivot pin 30 extending upwardly from a substantially planar base 32, pivot pin 30 being situated between intermediate sections 22 of lever handles 12L and R. In addition, there is provided a protective, connecting cover 34 for situating over pivot pin 30 and planar base 32 of pivot joint 14. Connecting cover 34 also assists with further joining of lever handles 12L and R. In these views, connecting cover 34 is held in place with a pair of threaded rivets 36 having alien wrench-type top holes.

In the first preferred embodiment of this invention, both lever handles (or arms) extend from their respective hammer base 25B, through their gripping 20 and intermediate 22 sections/regions before terminating at their respective forward/front tip ends 24L and R. While resembling thick triangular sections, each front tip is removably mounted (secured) to the lever handle by respective bolting means, allen-head, rivet bolts 40L and R, as representatively shown. It is to be understood that still other known (or subsequently developed) apparatus connector means may be used to supplement said rivets or as a full, total substitute therefor.

In the first views of tool 10 in FIGS. 1A through 2C, the two forward/front tip ends are NOT symmetrical . . . on purpose. Rather, the left tip 24L is made slightly smaller than its right tip counterpart 24R. In that manner, right tip 24R will extend beyond and at least partially overlap left tip 24L (though it is to be understood that the left and right designations are for ease of labeling purposes; depending on the operator's preference and/or hand strength-dexterity, the tool can be flipped over and operated in the reverse direction as shown above. Ideally, these tips are made from a high carbon steel, with or without carbide portions.

In the second version of tool 110, shown in FIGS. 3A through D, most of the features common to those in the first embodiment are commonly numbered in the next hundred series. However, at the uppermost tips of handles 112L and R, there is shown a tip variation wherein one of the two tip ends, actually left tip 124L, having an atypical claw end 124C with split claw teeth T. As the latter can be used to pry out/up nails and/or staples, even more versatility can be added to the same multiple use tool.

Figure 4A:
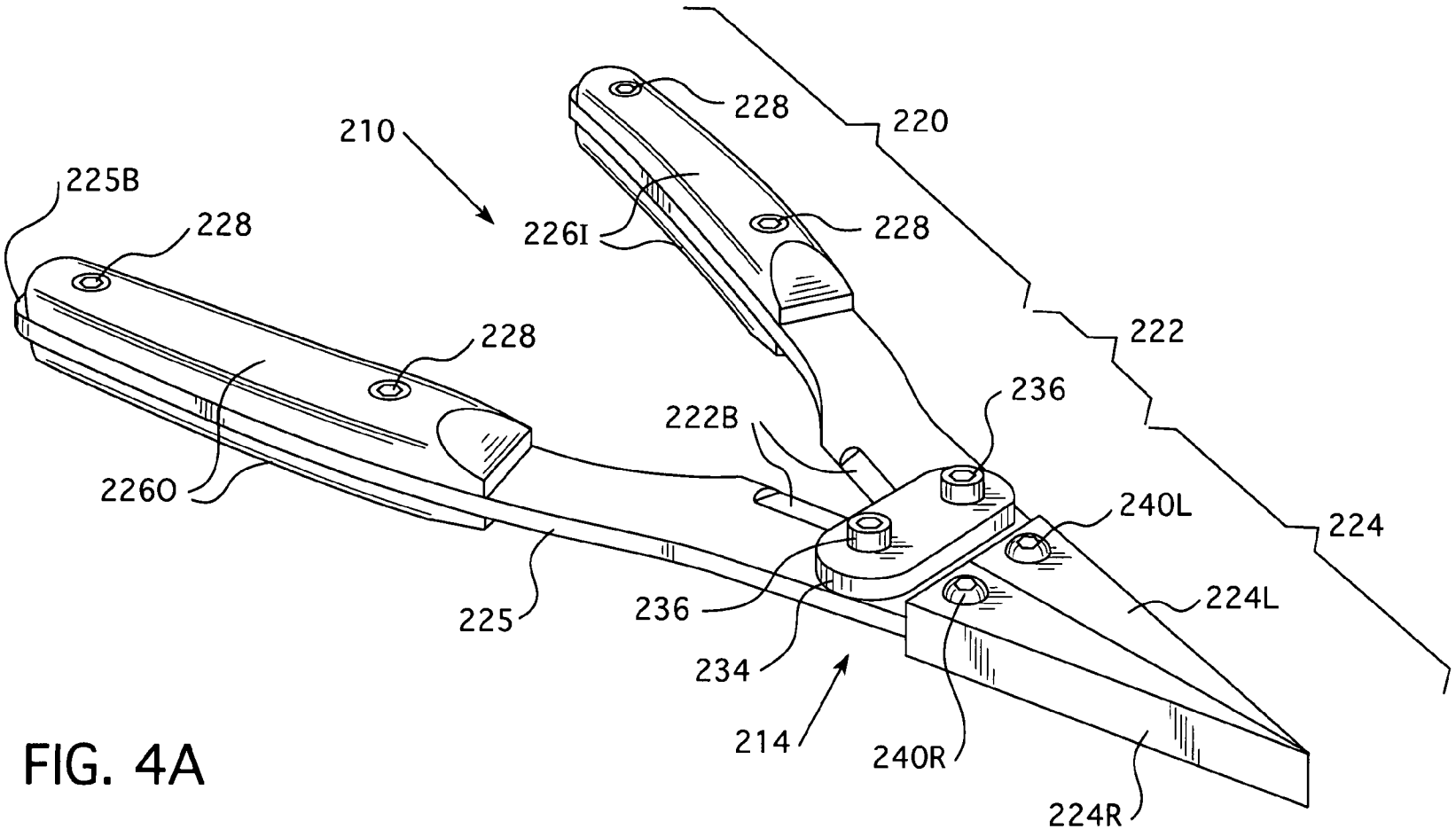
FIG. 4A is a perspective view of a third tool embodiment having symmetric tips from its upper right corner before being squeezed to pry something apart.
Figure 4B:
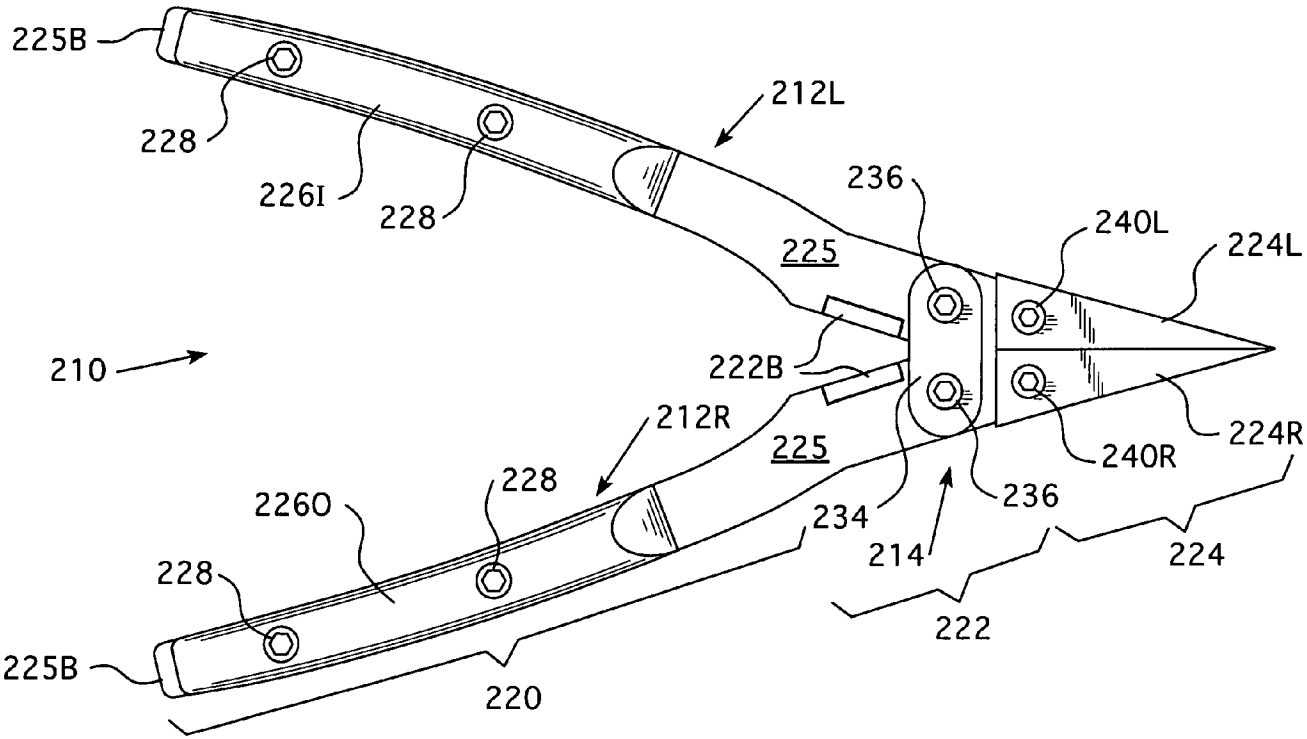
FIG. 4B is a top plan view of the tool from FIG. 4A.
Figure 4C:
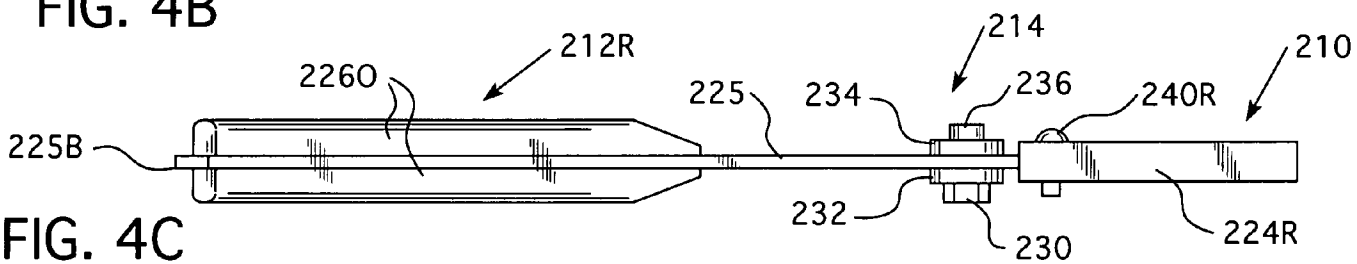
FIG. 4C is a plan view of the right side of the tool from FIG. 4A.

In FIGS. 4A through 4C, yet another type tool 210 is shown having as its major difference from the other models, left and right forward/front tips 224L and R that are substantially symmetrical. Also in these views, another versatility aspect is shown. On an inner edge to both intermediate sections 222L and R, there is included beveled edges 222B that, when duly sharpened, would allow this same tool to be used for cutting wire. Though not shown, a series of semi-circular holes may be added to these beveled edges, or situated adjacent to same, for allowing the same device to be used for stripping the outer covers to electrical wiring and the like.

Figure 5A:
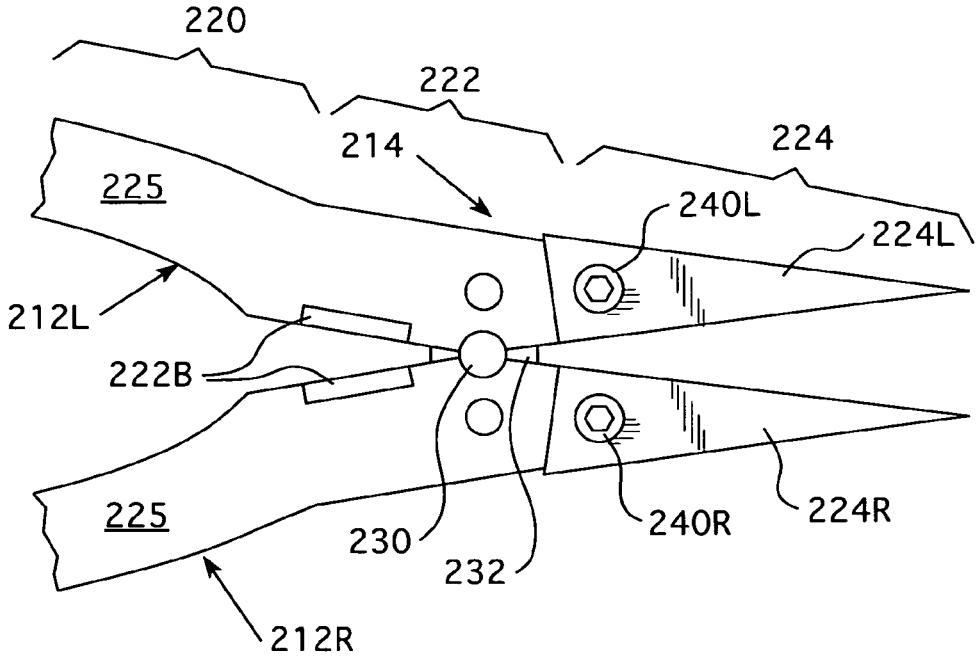
FIG. 5A is a top plan view of the connection between left and right side tool members with its top connector band removed.
Figure 5B:
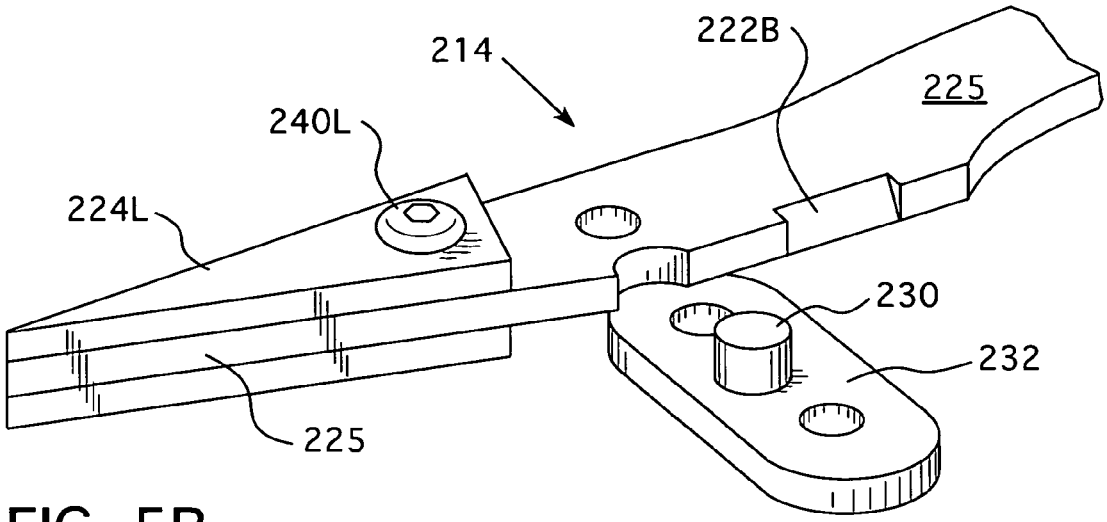
FIG. 5B is a perspective view showing the tool's left side arm at least partially separated from its central connector clip.

Finally, in FIGS. 5A and B, there is shown a close up view of the connector bands to a representative pryer/plier device, i.e. tool 210 of FIGS. 4A through 4C. Particularly, in these views, one can better see the separate, disassembled components making up its pivot joint 214. Note the metallic pivot pin 230 extending upwardly from its metallic, substantially planar base 232. They would fit in a specially cut, semi-circularly shaped groove on the inner edges to BOTH intermediate sections (though only one such groove 222G is shown). Once duly situated, this pivot joint assembly would have a protective outer cover riveted thereto, said cover being numbered 234 in the earlier views of FIGS. 4A through C.

While the invention has been described in conjunction with several embodiments, it is to be understood that many alternatives, modifications, and variations will be apparent to those skilled in the art in light of the foregoing description. Accordingly, this invention is intended to embrace all such alternatives, modifications, and variations which fall within the spirit and scope of the appended claims.

What is claimed is:

1. A multi-purpose tool that makes prying possible without need of a lever point, said tool comprising:

a pair of handles pivotally connected at an intermediate pivot joint, each handle comprising a gripping section, an intermediate section and a front tip section all located on a same side of the pivot joint such that movement of the gripping sections towards each other spreads the front tip sections apart;

said pivot joint including a substantially circular pivot pin on a substantially planar base, said pivot pin being situated between the intermediate sections of both handles, and a connecting cover for situating over the pivot pin and planar base and further joining both handles together.

2. The multi-purpose prying tool of claim 1 wherein a first gripping section extends to a first front tip section and a second gripping section extends to a second front tip section.

3. The multi-purpose prying tool of claim 2 wherein the first front tip section and the second front tip section are asymmetrical.

4. The multi-purpose prying tool of claim 3 wherein the first front tip section extends outwardly beyond and partially overlaps with the second front tip section.

5. The multi-purpose prying tool of claim 3 wherein the first front tip section terminates in a claw end suitable for removing nails and staples.

6. The multi-purpose prying tool of claim 2 wherein the first and second front tip sections are symmetrical.

7. The multi-purpose prying tool of claim 1 wherein at least one handle has a lowermost end that extends outwardly beyond its gripping section and is adapted for hammering to better wedge the tool in place before prying.

8. The multi-purpose prying tool of claim 7 wherein the lowermost handle end is substantially planar.

9. The multi-purpose prying tool of claim 1 wherein both handle intermediate sections include a beveled edge sharpened for wire-cutting.

10. The multi-purpose prying tool of claim 1 wherein at least one front tip section removably connects to the handle for replacement with another front tip section.

11. The multi-purpose prying tool of claim 10 wherein both front tip sections can be replaced with alternately-shaped front tip sections.

12. A hand-held prying tool comprising:

a pair of levers each having a handle portion, an intermediate portion and a forward tip portion; and a pivot assembly comprising:

an elongate portion which extends substantially perpendicular to the intermediate portion of both levers;

a central knob extending upwardly from one side of the elongate portion and about which the pair of levers axially rotate relative to each other for effecting opening and closing of the forward tip portions; and a top band for covering the elongate portion and joining the levers to each other.

13. The prying tool of claim 12 wherein the forward tip portions of the pair of levers are asymmetrical.

14. The prying tool of claim 13 wherein a first forward tip portion extends outwardly beyond and partially overlaps with a second forward tip portion.

15. The prying tool of claim 13 wherein a first forward tip portion terminates in a claw end suitable for removing nails and staples.

16. The prying tool of claim 12 wherein the forward tip portions of the pair of levers are symmetrical.

17. The prying tool of claim 12 wherein at least one handle has a lowermost end that extends outwardly beyond its gripping section and is adapted for hammering to better wedge the tool in place before prying.

18. The prying tool of claim 12 wherein one or both forward tip portions can be replaced with the same shape or an alternately-shaped forward tip portion.

19. A multiple purpose, plier-type tool that enables stand alone prying expansion and/or prying between adjacent surfaces, said tool comprising:

(i) a pair of lever handles joined to each other for axial rotation relative to one another at an intermediate region of both lever handles, each lever handle comprising:

an operator-gripping end, an intermediate joint-connecting region, and an uppermost end to which a spreading tip is removably connected, said lever handle being integrally formed from a one piece, hardened metal shaft center that extends at least partially beyond one or more gripper covers at the operator-gripping end so as to enable operator hammering at said extending portion to better wedge the tool in place, if needed, before prying; and (ii) an intermediate pivot joint about which movement of the operator-gripping ends towards each other causes the spreading tips at both uppermost ends to move away from one another, said pivot joint comprising:

a substantially circular pivot pin on a substantially planar base, said pivot pin being situated between the intermediate regions of both lever handles, and a protective cover for situating over the pivot pin and further connecting both lever handles to one another.

20. The plier-type tool of claim 19 wherein the spreading tips at the uppermost end of both lever handles are selected from the group consisting of:

(a) a pair of symmetrically-shaped, spreading wedges;

(b) a pair of asymmetrically-shaped wedges with one of said tips made longer to at least partially overlap its partner tip; and (c) a pair of asymmetrically-shaped tips, one being wedge-like and its partner tip terminating in a claw end suitable for removing nails and staples.

* * * * *